US007013759B1

(12) United States Patent
Childress, II

(10) Patent No.: US 7,013,759 B1
(45) Date of Patent: Mar. 21, 2006

(54) APPARATUS FOR HANDLING TUBULARS AND METHOD

(75) Inventor: Lawrence E. Childress, II, Lafayette, LA (US)

(73) Assignee: Access Oil Tools, Inc., Broussard, LA (US)

( * ) Notice: Subject to any disclaimer, the term of this patent is extended or adjusted under 35 U.S.C. 154(b) by 0 days.

(21) Appl. No.: 11/217,708

(22) Filed: Aug. 31, 2005

(51) Int. Cl.
*B25B 17/00* (2006.01)
*B25B 29/00* (2006.01)
*B25B 13/50* (2006.01)

(52) U.S. Cl. ..... 81/57.34; 81/57.33; 81/57.15; 81/57.16; 81/57.21; 81/57.35; 81/57.24; 81/57.17; 81/57.4; 81/57; 81/56; 74/89.17; 74/422

(58) Field of Classification Search .... 81/57.33–57.35, 81/57.15–57.18, 57.2, 57.21, 57.24, 57.4, 81/56, 57; 74/89.17, 422
See application file for complete search history.

(56) References Cited

U.S. PATENT DOCUMENTS 3,902,385 A * 9/1975 Haby ..... 81/57.34
4,648,292 A * 3/1987 Haynes et al. ..... 81/57.16
4,869,137 A * 9/1989 Slator ..... 81/57.18
5,000,065 A * 3/1991 Haynes ..... 81/57.2
5,823,074 A * 10/1998 Ahlstone ..... 81/57.34
6,829,967 B1 * 12/2004 Kemp ..... 81/57.15

* cited by examiner

*Primary Examiner*—Joseph J. Hall, III
*Assistant Examiner*—Bryan Muller
(74) *Attorney, Agent, or Firm*—C. Dean Domingue; Robert L. Waddell; Ted A. Anthony

(57) ABSTRACT

A device for torquing a tubular connection. The device comprises an upper assembly having an upper jaw member, a lower assembly having a lower jaw member, an upper gear for advancing the upper jaw member, and a lower gear for advancing the lower jaw member. The upper jaw member includes a first jaw operatively associated with a first rack, a second jaw operatively associated with a second rack, and a third jaw operatively associated with a third rack. The lower jaw member includes a fourth jaw operatively associated with a fourth rack, a fifth jaw operatively associated with a fifth rack, and a sixth jaw operatively associated with a sixth rack. A method of torquing a first tubular with a second tubular is also disclosed.

24 Claims, 8 Drawing Sheets

APPARATUS FOR HANDLING TUBULARS AND METHOD

BACKGROUND OF THE INVENTION

This invention relates to an apparatus for handling tubulars. More particularly, but not by way of limitation, this invention relates to an apparatus for centering tubular connections, applying torque to the tubular connections as well as breaking the tubular connection.

In the course of drilling wells, operators will find it necessary to threadedly connect and disconnect tubular strings. For instance, tubulars that are run into well bores will be required to be made up on the rig floor. As readily appreciated by those of ordinary skill in the art, operators will use specialized tools in order to create the necessary torque required to properly connect the tubulars.

Many problems have been experienced with prior art torque tools. For instance, in order to make up the box end to the pin end, the two tubulars must be properly aligned. Prior art tools have experienced significant problems with proper alignment. Also as appreciated by those of ordinary skill in the art, during the course of drilling, completing, or producing, an operator may use many different size tubulars. Hence, the jaws of the torque tools would have to be replaced, which is a time consuming and expensive operation due to high day rates charged by rigs.

Therefore, there is a need to have an apparatus for handling tubulars that can properly align a box end and pin end. There is also a need for an apparatus that can be used on tubulars that have varying outer diameters. There is also a need for an apparatus that is economical to manufacture and undemanding to maintain.

SUMMARY OF THE INVENTION

An apparatus for making up a tubular connection is disclosed. The apparatus comprises a first assembly having first jaw means, wherein the first jaw means includes a first driving jaw operatively associated with a first driving rack, a first driven jaw operatively associated with a first driven rack, and a second driven jaw operatively associated with a second driven rack. The apparatus further includes a second assembly having second jaw means, wherein the second jaw means includes a second driving jaw operatively associated with a second driving rack, a third driven jaw operatively associated with a third driven rack, and a fourth driven jaw operatively associated with a fourth driven rack. A first gear means, operatively associated with the first assembly, for advancing said first jaw means, and a second gear means, operatively associated with the second assembly, for advancing the second jaw means is included. The apparatus may further comprise a driver cylinder for driving the first and second driving jaw.

In one preferred embodiment, the first gear means includes a primary idler gear and a secondary idler gear, wherein the primary idler gear is engaged with the first driving jaw so that movement of the first driving jaw effects movement of the first driven jaw. Also in one preferred embodiment, the second gear means includes a primary idler gear and a secondary idler gear, wherein the primary idler gear is engaged with the first driving jaw so that movement of the first driving jaw effects movement of the second driven jaw.

The apparatus may further include a first load cylinder operatively attached to the first assembly for imparting a rotational force to the first assembly and to the second assembly. A second load cylinder may be included that is operatively attached to the second assembly for imparting a rotational force to the second assembly relative to the first assembly.

A method of torquing a first tubular with a second tubular is also disclosed. The method comprises providing a first apparatus and second apparatus, wherein the first apparatus comprises: a first driving jaw having a first and second driving rack, a first driven jaw having a first driven rack, a second driven jaw having a second driven rack, first gear means engaging the first driven rack and the first driving rack, and a second gear means engaging the second driving rack and the second driven rack; and wherein the second apparatus comprises: a second driving jaw having a third and fourth driving rack, a third driven jaw having a third driven rack, a fourth driven jaw having a fourth driven rack, third gear means engaging the third driving rack and the third driven rack, and a fourth gear means engaging the fourth driving rack and the fourth driven rack. The method further includes advancing the first driving jaw, engaging the first driving rack with teeth of the first gear means, and engaging the second driving rack with teeth of the second gear means. The method includes simultaneously advancing the first driving jaw, the first driven jaw and the second driven jaw, and simultaneously contacting the first driving jaw, the first driven jaw and the second driven jaw with the first tubular so that the first tubular is centered within the first apparatus.

Next, the second driving jaw is advanced and the third driving rack with teeth of the third gear means is engaged. The method further includes engaging the fourth driving rack with teeth of the fourth gear means, simultaneously advancing the second driving jaw, the third driven jaw and the fourth driven jaw, and simultaneously contacting the second driving jaw, the third driven jaw and the fourth driven jaw with the second tubular so that the second tubular is centered with the second apparatus. The first and second tubular can then be threadedly torqued together.

In one preferred embodiment, the step of advancing the first driving jaw device includes extending a piston from a driver cylinder so that the first driving rack and the second driving rack is advanced.

An advantage of the present invention is a gear-driven gripping method will be implemented in order to increase the accuracy of jaws between the upper and lower assembly. The gear-driven gripping method will eliminate the need for the operator to change jaws due to a change in tool size. Another advantage is that the jaw system will contain three jaws per tool that will be drawn together uniformly via gearing in order to ensure centering of the tubular consistently.

Yet another advantage is that the action as well as the geometry of the tool and jaws allows for equal velocity between the three (3) jaws as they approach the center of rotation. Another advantage is that the equiangular geometry of the jaw channels allows for constant equiangular geometry of the jaws themselves. This equiangular contact between the jaw face and the surface of the tubular creates equal forces at three points all equidistant from each other. Still yet another advantage is that the equal velocity paired with the geometry of the jaw travel allows for centering of the tubular with the center of rotation of the tool repeatable constantly.

A feature of the present invention is that each assembly will implement a single gripping cylinder used in the actuation of all three (3) jaws. Another feature is that the four (4) gears and racks will be used per assembly. Yet another feature is that two (2) torque cylinders will be used between the required two (2) assemblies per torque tool. Another feature is that the two (2) torque cylinders being used in series will allow for torques to be created that meet and/or exceed the requirements for this tool during operation. Still yet another feature is that the upper and lower assemblies are interchangeable in the preferred embodiment. Another feature includes the use of hydraulic or electronic remote control of the activation means.

DETAILED DESCRIPTION OF THE PREFERRED EMBODIMENTS

Figure 1:
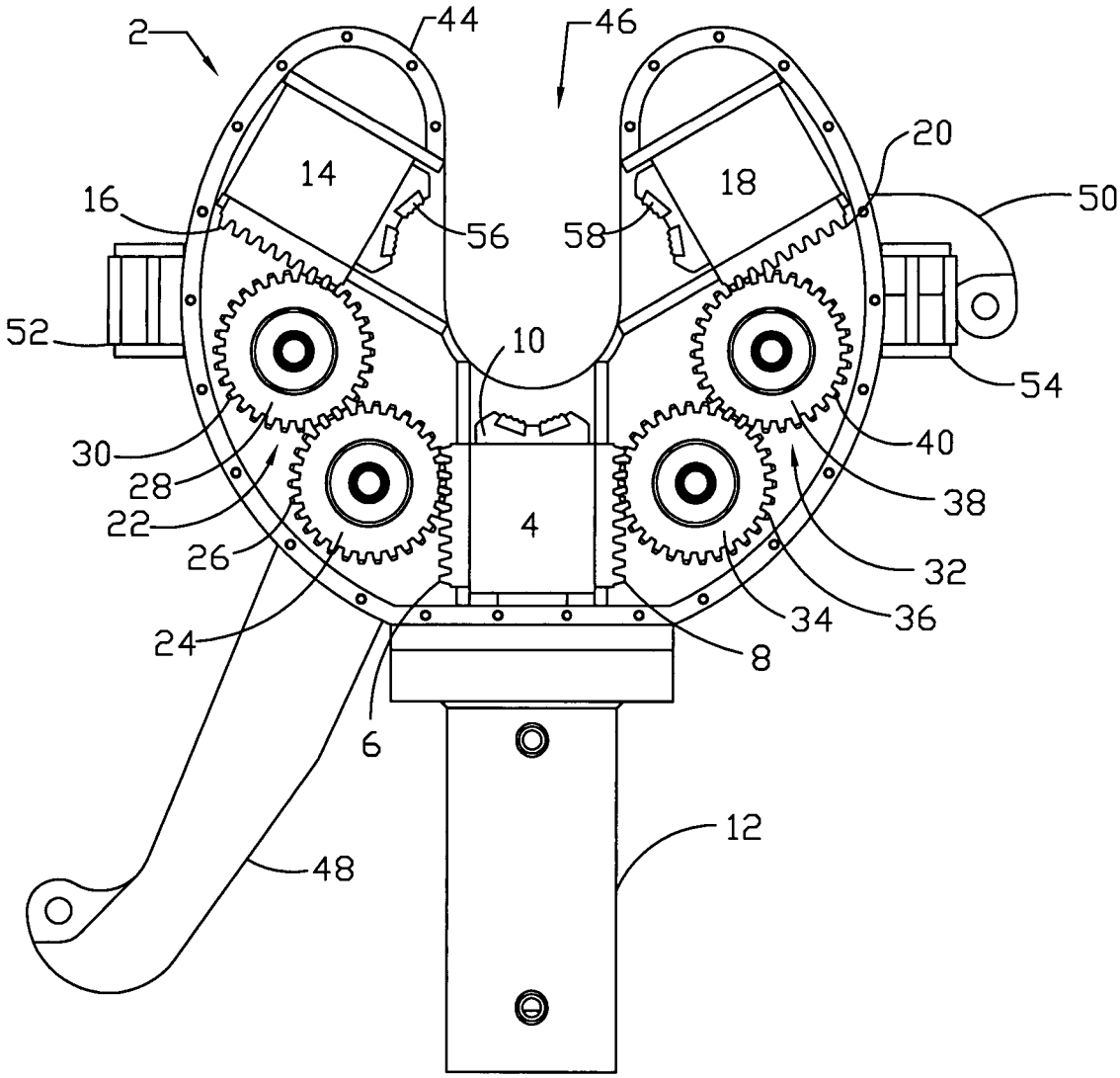
FIG. 1 is a partial cross-sectional view of the preferred embodiment of the self-centering apparatus with the jaws in the expanded position.

Referring now to FIG. 1, a partial cross-sectional view of the preferred embodiment of the self-centering apparatus 2 with the jaws in the expanded position will now be described. In this preferred embodiment, the driving jaw device 4 is shown having a rack device, and in particular, the first rack 6 and the second rack 8. The driving jaw device 4 further includes the jaw die inserts 10, and wherein the jaw die inserts 10 will engage the tubular as will be more fully described later in the application. FIG. 1 shows the hydraulic cylinder 12 which is operatively attached to the driving jaw device 4. The hydraulic cylinder 12 acts as the driving cylinder for the driving jaw device 4.

FIG. 1 further depicts the first driven jaw 14 that will have the third rack 16, as well the second driven jaw 18 that contains the fourth rack 20. The self-centering apparatus 2 will contain the first gear means 22 that contains the primary idler gear 24 with associated teeth 26 and the secondary idler gear 28 with associated teeth 30. The self-centering apparatus 2 will contain the second gear means 32 that contains the primary idler gear 34 with associated teeth 36 and the secondary idler gear 38 with associated teeth 40.

Figure 6:
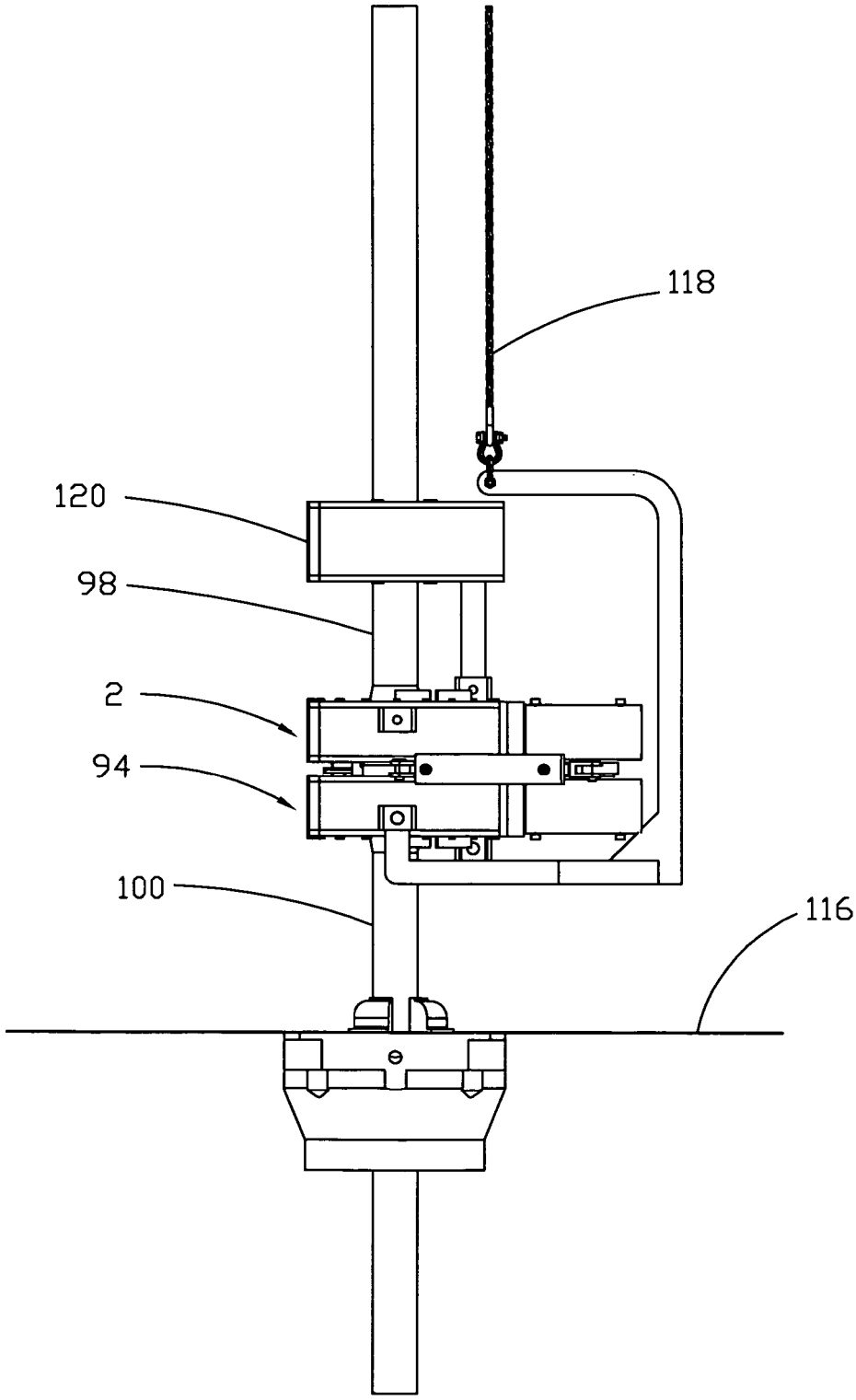
FIG. 6 is a perspective view of the self-centering apparatus on a rig floor.

As seen in FIG. 1, the driving jaw device 4, the driven jaws 14, 18, and associated gear means are contained within the body 44, wherein the body 44 is generally cylindrical and has the opening 46 for insertion and removal of the tubular member, as is well understood by those of ordinary skill in the art. The body 44 will have fixedly attached the rear cylinder body mount 48 for a first torque cylinder (not shown in this figure), for torquing a tubular connection, as well as the forward cylinder body mount 50 which will be attached to a second torque cylinder (not shown in this figure), for torquing the tubular connection, as will be more fully explained later in the application. Mounting locations 52, 54 are included for different types of support systems. These support systems include, but are not limited to a hanger style system as depicted in FIG. 6 as well as a floor mounted support and positioning system. These mounting locations will also be used for mounting accessories to the tool, as understood by those of ordinary skill in the art. The first driven jaw 14 will have the jaw die insert 56 for engaging the tubular, and the second driven jaw 18 will have the jaw die insert 58 for engaging the tubular. The die inserts 10, 56 and 58 will contain a frictional outer surface in order to engage and capture the tubular thereby preventing the tubular from rotating and moving longitudinally, as well understood by those of ordinary skill in the art. The frictional outer surface maybe of a jagged, tooth like outer surface. In one embodiment, the die inserts have several rows of teeth.

Figure 2A:
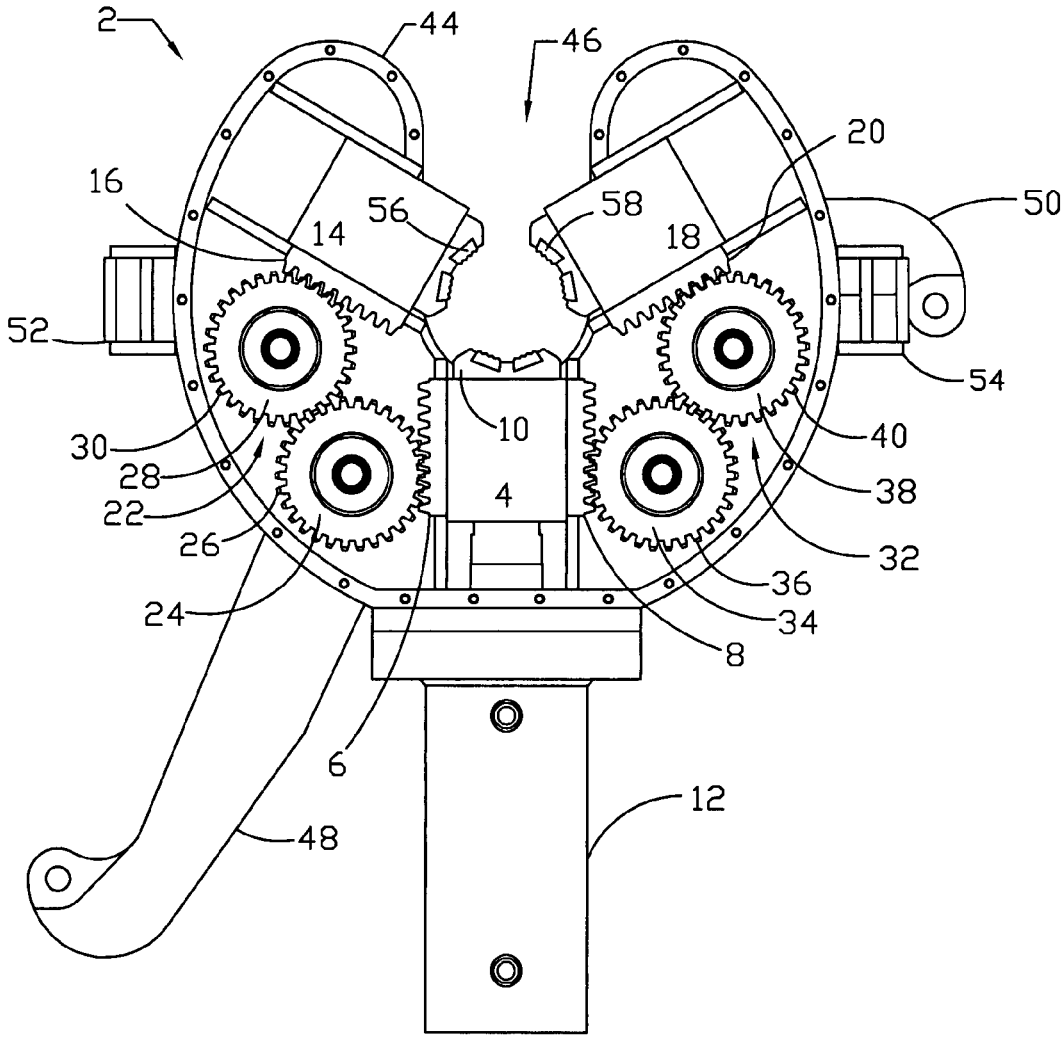
FIG. 2A is the partial cross-sectional view of the self-centering apparatus seen in FIG. 1 with the jaws in the partially contracted position.
Figure 2B:
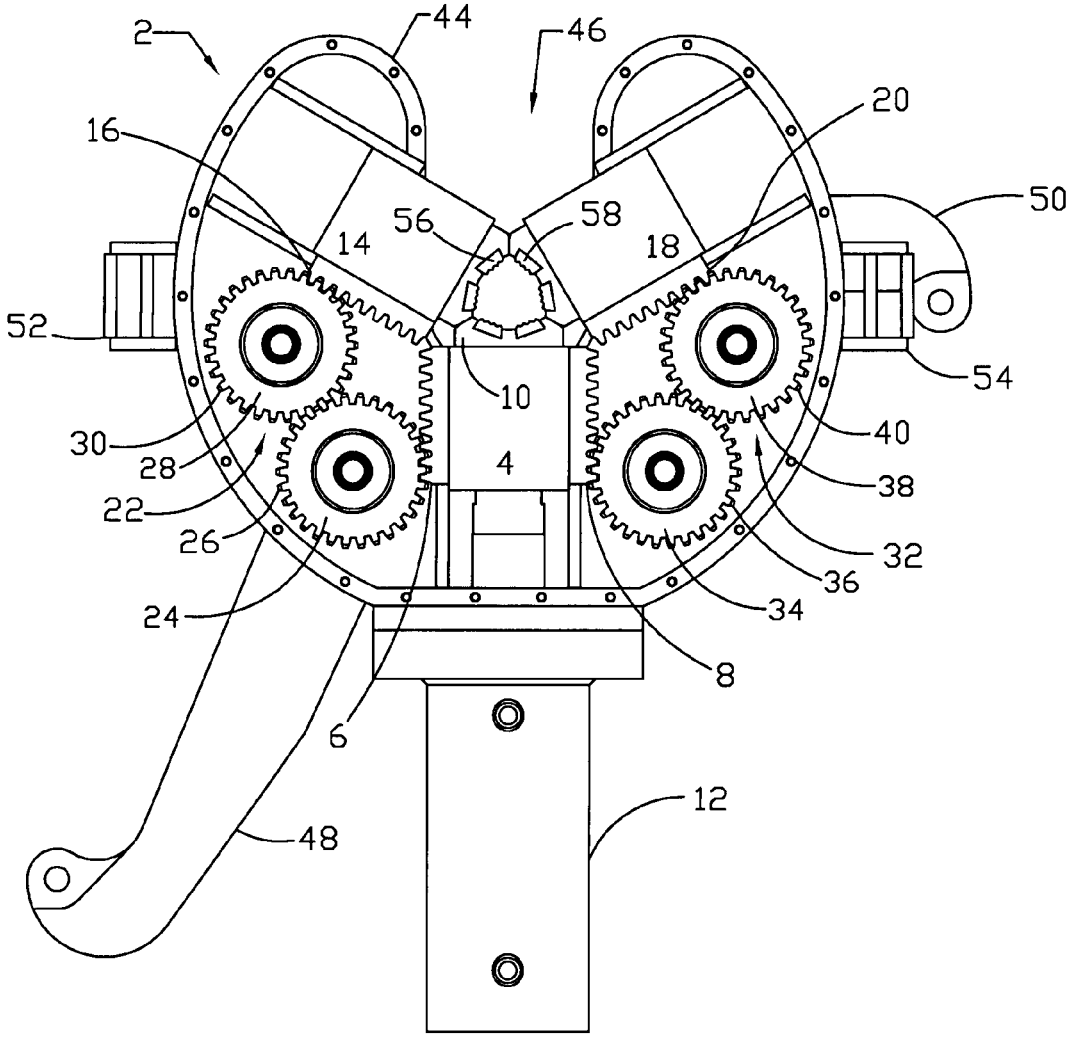
FIG. 2B is the partial cross-sectional view of the self-centering apparatus seen in FIG. 2A with the jaws in the fully contracted position.

The operation of the apparatus will now be described with reference to FIGS. 2A and 2B, which depicts the partial cross-sectional view of the self-centering apparatus seen in FIG. 1 with the sequential view of the jaws being moved to the contracted position. It should be noted that like numbers appearing in the various figures refer to like components. Hence, the operator will activate the hydraulic cylinder 12 which will cause the driving jaw device 4 to expand (extend) which in turn causes the primary idler gear 24 and primary idler gear 34 to rotate. The teeth 26 will then transfer its motion to teeth 30 on the secondary idler gear 28, and the teeth 36 will transfer its motion to teeth 40 on the secondary idler gear 38. As shown in FIG. 2A, the rotation of teeth 30 will be transferred to the rack 16 thereby causing movement of the driven jaw 14 and the rotation of teeth 40 will be transferred to the rack 20 thereby causing movement of the driven jaw 18. The movement to the center of the driving jaw 4, the driven jaw 14, and the driven jaw 18 will occur simultaneously so that the radial force on the tubular will be exerted equally, according to one preferred embodiment. In other words, simultaneous movement of the three jaws has to do with the effect of concentricity of the tubular with the tool itself consequently causing equiangular contact on the tubular. Equiangular radial force applied to the tubular is related to this same phenomenon but the radial force itself is due to the distribution of force caused by the geartrain. FIG. 2B depicts the partial cross-sectional view of the self-centering apparatus seen in FIG. 2A with the jaws in the fully contracted position.

Figure 3:
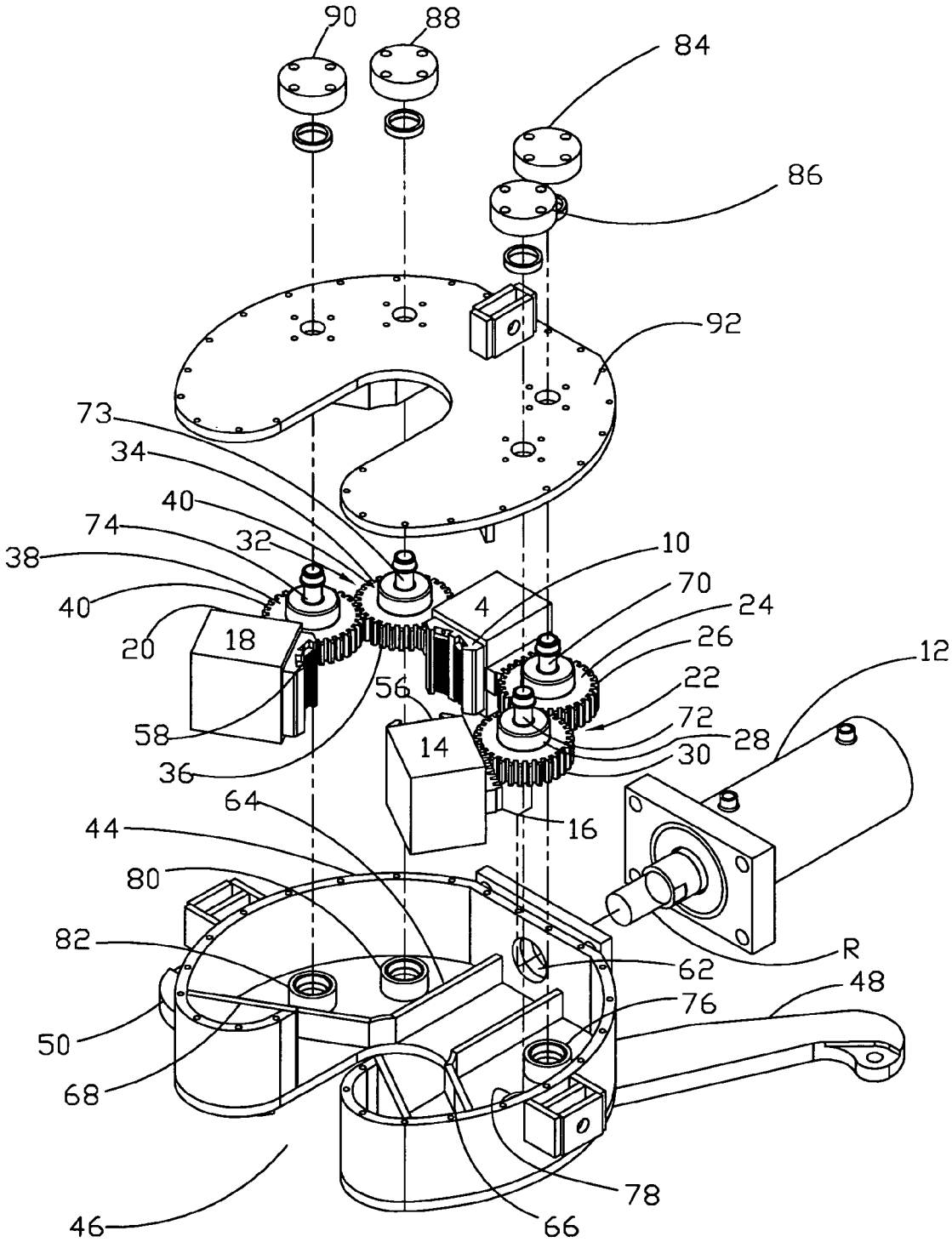
FIG. 3 is an exploded, perspective view of the self-centering apparatus seen in FIG. 1.

Referring now to FIG. 3, an exploded, perspective view of the self-centering apparatus seen in FIG. 1 will now be described. The driving jaw device 4 is seen with the rack 8. The gear means 32 is shown, and wherein the teeth 36 engage the rack 8, and the teeth 40 engage the teeth 36. The second driven jaw 18 is shown with rack 20, and wherein the rack 20 engages the teeth 40. FIG. 3 further depicts the gear means 22, and wherein the teeth 26 engage the teeth 30. The first driven jaw 14 is illustrated with the rack 16, and wherein the rack 16 engage teeth 30. The hydraulic cylinder 12 is shown, and wherein the body 44 has the opening 62 through which a piston rod "R" from the hydraulic cylinder 12 will be disposed. FIG. 3 depicts where the driving jaw device 4, and the driven jaws 14, 18 are in the general configuration of a rectangular block, and at one end will be situated the jaw die inserts 10, 56, 58. The jaw die inserts 10, 56, 58 are to engage and grasp the tubular, as well understood in the art.

As shown in FIG. 3, the body 44 contains side walls that serve as compartments and tracks 4 for the driving jaw device 4, and the driven jaws 14, 18; more particularly, the body 44 contains the side walls 64, 66, 68. FIG. 3 illustrates that primary idler gear 24 has the gear shaft 70, the secondary idler gear 28 has the gear shaft 72, the primary idler gear 34 has the gear shaft 73, and the secondary idler gear 38 has the gear shaft 74. Additionally, the body 44 contains the internal bearing caps 76, 78 and the internal bearing caps 80, 82 for cooperation with the gear shafts.

FIG. 3 also contains the bearing caps 84, 86, 88, 90, and wherein bearing cap 84 is operatively associated with the gear shaft 70, bearing cap 86 is operatively associated with gear shaft 72, bearing cap 88 is operatively associated with gear shaft 72 and bearing cap 90 is operatively associated with gear shaft 74. The top cover plate 92 is disposed on top and will be connected to the body 44 using conventional means such as nuts and bolts.

Figure 4:
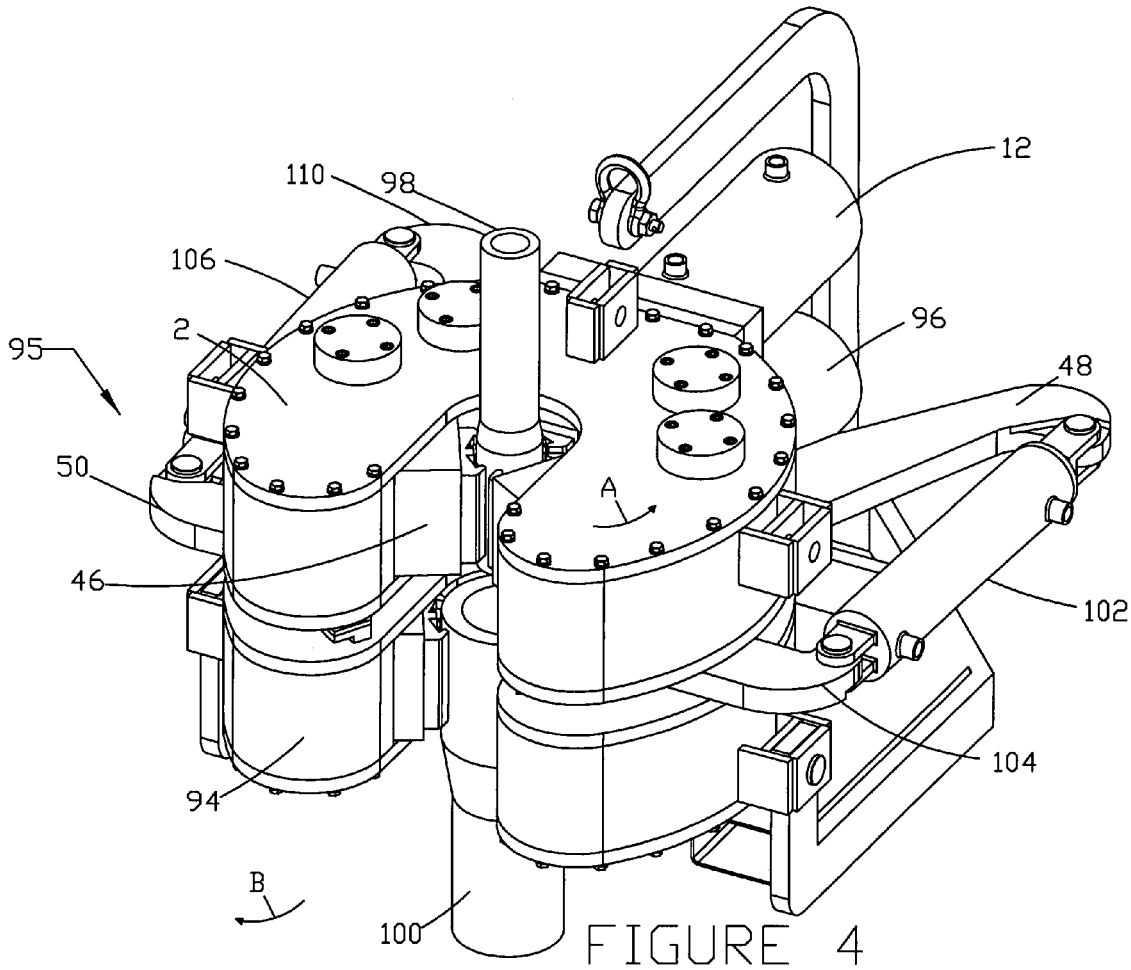
FIG. 4 is a perspective view of a first and second self-centering apparatus positioned about a first and second tubular.

Referring now to FIG. 4, a perspective view of a first and second self-centering apparatus positioned about a first and second tubular will now be described. More specifically, the first self-18 centering apparatus 2 is shown, along with a tandem second self-centering apparatus 94. The second self-centering apparatus 94 will be of essentially identical construction as the first self-centering apparatus 94 and apparatus 94 is simply rotated 180 degrees i.e. a mirror image. The first self-centering apparatus 2 and the second self-centering apparatus 94 may be collectively known as the self-centering device 95. FIG. 4 depicts the hydraulic cylinder 12 of the first apparatus 2 as well as the hydraulic cylinder 96 of the second self-centering apparatus 94.

A first tubular member 98 is disposed within the opening 46 of the first self-centering apparatus 2. As shown in FIG. 4, the jaws have been drawn to the center to engage the tubular member 98 according to the teachings of the present invention. As those of ordinary skill in the art will recognize, the second self-centering apparatus 94 surrounds a second tubular member 100 so that the first and second tubular can be threadedly torqued together, or alternatively, to be disconnected. As shown in FIG. 4, the outer diameter of the second tubular member 100 is larger than the outer diameter of the first tubular member 98. The jaws of the second self-centering apparatus 94 will close and engage the second tubular member 100 as previously described, despite the larger outer diameter. FIG. 4 illustrates that concentricity of the upper and lower tubulars will be maintained regardless of differences, large or small, in the diameter of one tubular relative to the other.

A load cylinder 102 is shown attached to the forward cylinder body mount 104 at one end and attached to the rear cylinder body mount 48 at the other end. Body mount 104 is attached to the apparatus 94. Also, the load cylinder 106 is shown attached to the forward cylinder body mount 50 at one end and attached to the rear cylinder body mount 110 at the end. Body mount 50 is attached to apparatus 2 and body mount 110 is attached to apparatus 94. As those of ordinary skill in the art will recognize, activation of load cylinder 102 will extend a piston rod thereby creating a rotational force in a first direction (as denoted by the arrow "A"). The activation of load cylinder 106 will extend a piston rod thereby creating a rotational force in a second direction (as denoted by the arrow "B"). In most instances, the tubular 100 is being held stationary within the rotary table, as is well understood by those of ordinary skill in the art. Hence, the activation of load cylinders 102 and 106 imparts a rotational force such that self-centering apparatus 2 is rotated relative to self-centering apparatus 94 which in turn torques the tubulars 98 and 100 together. By activation of both cylinders 102 and 106, the tubular members 98 and 100 can be threadedly coupled with the proper amount of torque in this manner.

Figure 5:
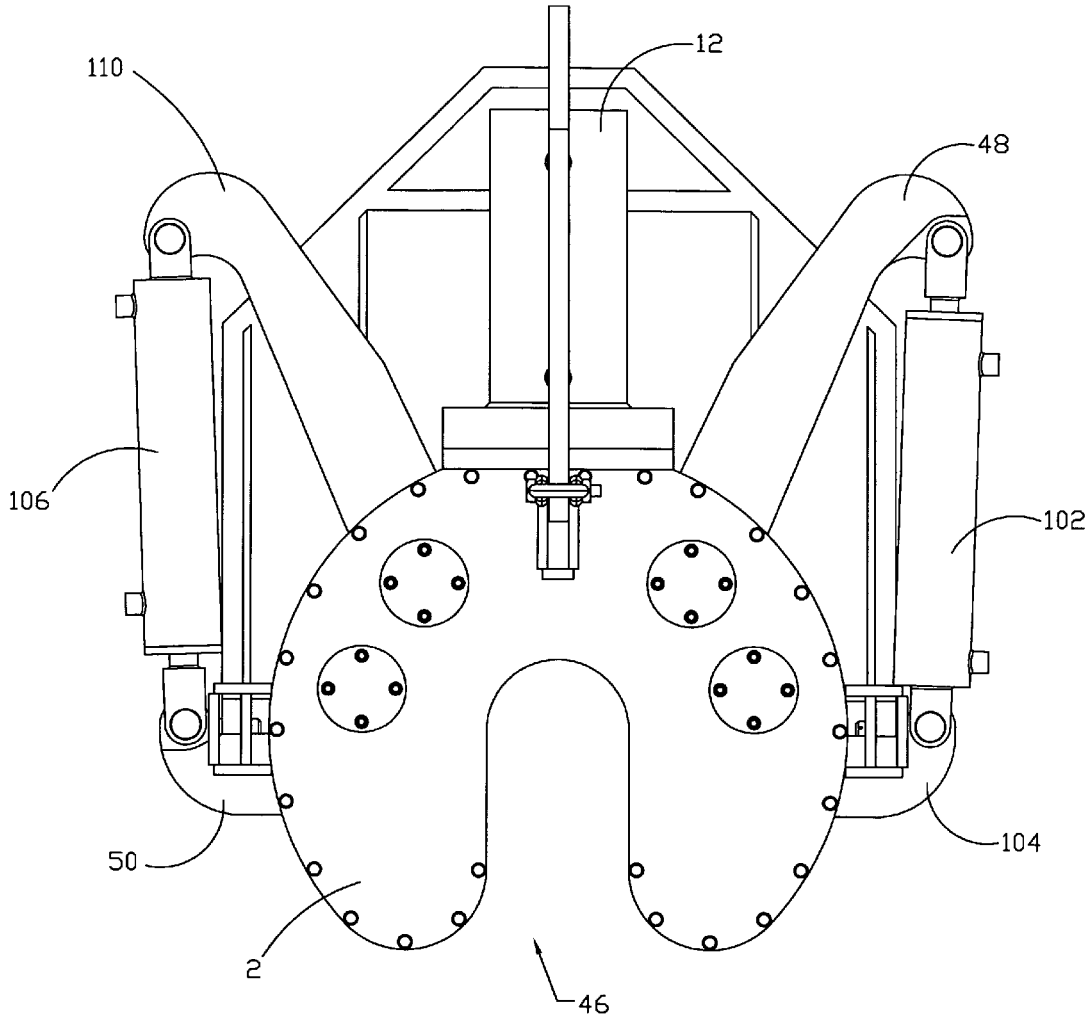
FIG. 5 is a top view of the first and second self-centering apparatus seen in FIG. 4.

FIG. 5 is a top view of the first self-centering apparatus 2 and the second self-centering apparatus 94 seen in FIG. 4. More specifically, FIG. 5 depicts the apparatus 2 and 94 in the open throat position.

In FIG. 6, which is the most preferred embodiment, the self-centering apparatus 2 and self-centering apparatus 94 will be used on a rig floor 116, and hence, the apparatuses 2, 94 will be operatively connected to the derrick using conventional, and well known means such as a hoist 118. On the rig floor 116, the tubular member 100 will be disposed within the rotary table, while the tubular member 98 will be suspended from the derrick. Operators will find it desirable to use a tubing spinner 120, and wherein the tubing spinner will be positioned on top of the self-centering apparatus 2. Tubing spinners are well known and commercially available from Grey EOT Corporation under the name 4 D R Spinner. After the self-centering apparatus 2 and the self-centering apparatus 94 has centered the tubular 98 relative to tubular 100, the tubing spinner 120 will spin the tubular member 98 which will threadedly engage the tubular member 98 with the tubular member 100. According to the teachings of this invention, after the spinner has threadedly made-up the connection, the self-centering apparatus 2 and the self-centering apparatus 94 can then be utilized to provide the proper amount of torque to the connection.

It should be noted that the self-centering apparatus 2 and self-centering apparatus 94 can be utilized on horizontal applications. In other words, the self-centering device can be rotated 90 degrees, and therefore, the self-centering device can be used on the surface in the industry for a lay-down service, bucking application, horizontal service, or multi-angular applications.

Figure 7:
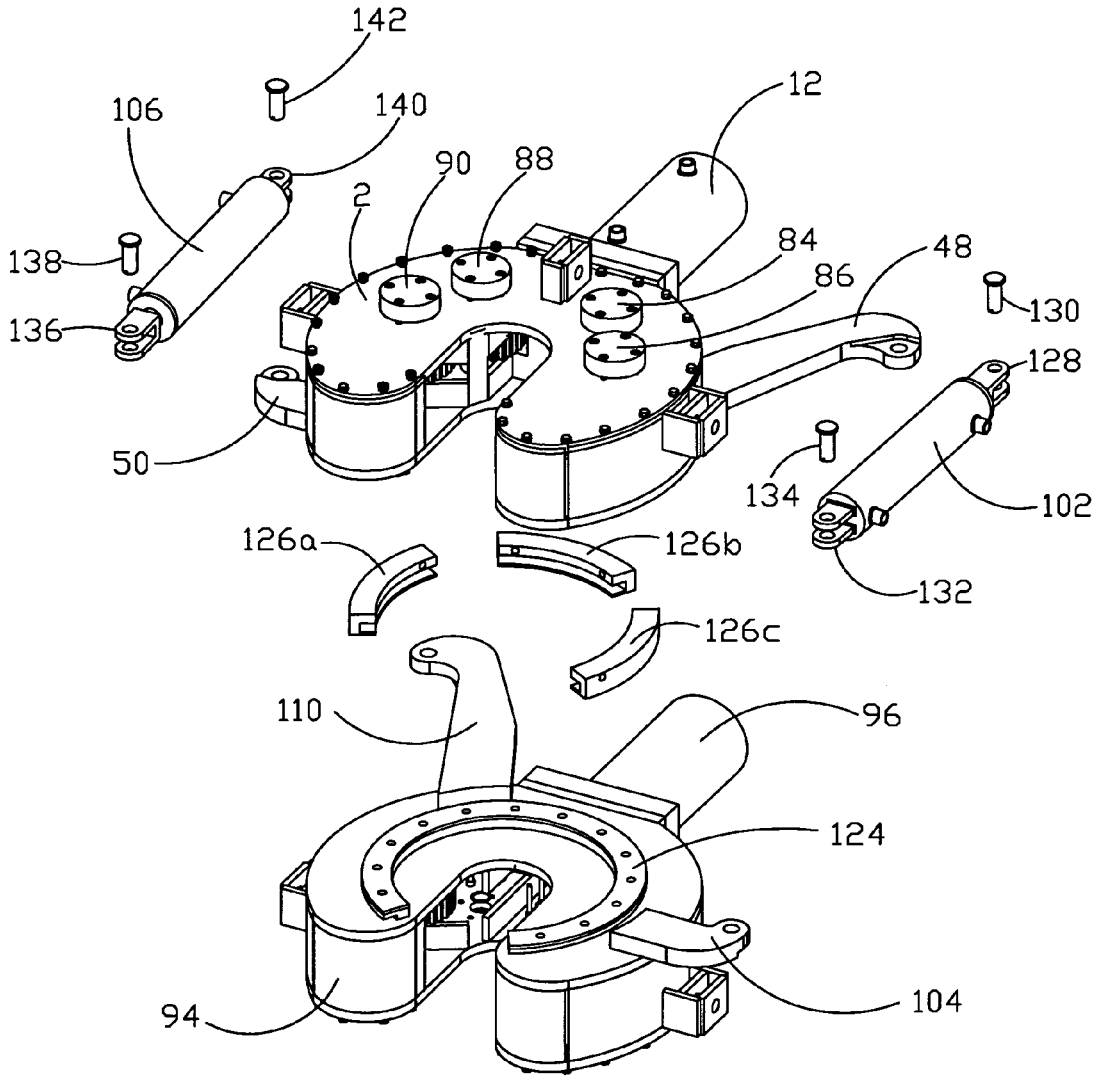
FIG. 7 is an exploded, perspective view of the first and second self-centering apparatus that depicts the load cylinders.

Referring now to FIG. 7, an exploded, perspective view of the first and second self-centering apparatus will now be described. FIG. 7 shows, among other things, the load cylinders 102, 106 connections. The self-centering apparatus 2 is shown, and wherein the forward cylinder body mount 50 and the rear cylinder body mount 48 is attached to the apparatus 2 as shown. The bearing caps 84–90 are shown, along with the hydraulic cylinder 12 that will extend the piston rod, as previously described. The second self-centering apparatus 94 is shown, and wherein the apparatus 94 includes the forward cylinder body mount 104 and the rear cylinder body mount 110. The hydraulic cylinder 96 that will extend a piston rod, as previously described, is also shown. FIG. 7 further depicts the flange rim 124 that is attached to the apparatus 94, as well as the reciprocal flange rims 126*a*, 126*b*, 126*c* that will allow slidable attachment with the apparatus 2 i.e. apparatus 2 and apparatus 94 can rotate independently of each other.

The load cylinder 102 will be attached at a first eyelet end 128 to the rear cylinder body mount 48 via the pin 130. The second eyelet end 132 will be attached to the body mount 104 via pin 134. FIG. 7 also depicts the load cylinder 106 that will have a first eyelet end 136 attach to the forward cylinder body mount 50 via pin 138 and a second eyelet end 140 connected to the rear cylinder body mount 110 via pin 142. As previously described, the activation of cylinders 102 and 106 will impart a rotational force on apparatus 2 and apparatus 94 since each load cylinder is attached to both apparatuses 2, 94. Each apparatus will experience a rotational force in a different direction thereby allowing the tubulars to be torqued. It should be noted that the load cylinders 102 and 106 described herein are also used to disconnect a made-up joint i.e. the load cylinders 102 and 106 can also be used for disconnecting threadedly connected tubulars.

While the particular invention as herein shown and disclosed in detail is fully capable of obtaining the features and providing the advantages hereinbefore stated, it is to be understood that this disclosure is merely illustrative of the presently preferred embodiments of the invention and that no limitations are intended other than as described in the appended claims.

I claim:

1. An apparatus for centering a tubular, the apparatus comprising:

an upper assembly having upper jaw mechanism;

upper gear means for advancing said upper jaw means;

wherein said upper jaw means includes a first driving jaw operatively associated with a first driving rack and a second driving rack, a first driven jaw operatively associated with a first driven rack, and a second driven jaw operatively associated with a second driven rack.

2. The apparatus of claim 1 further comprising a lower assembly having lower jaw mechanism and lower gear means for advancing said lower jaw mechanism.

3. The apparatus of claim 2 wherein said lower jaw mechanism includes a second driving jaw operatively associated with a third driving rack and a fourth driving rack, a third driven jaw operatively associated with a third driven rack, and a fourth driven jaw operatively associated with a fourth driven rack.

4. The apparatus of claim 3 wherein upper gear means comprises:

a first gear mechanism operatively associated with said first driving jaw and said first driven jaw;

a second gear mechanism operatively associated with said first driving jaw and said second driven jaw;

a first driver cylinder for driving said first driving jaw.

5. The apparatus of claim 4 wherein said first driving jaw, said first driven jaw and said second driven jaw contain a tong die insert.

6. The apparatus of claim 4 wherein said lower gear means comprises:

a third gear mechanism operatively associated with said second driving jaw and said third driven jaw;

a fourth gear mechanism operatively associated with said second driving jaw and said fourth driven jaw;

a second driver cylinder for driving said second driving jaw.

7. The apparatus of claim 6 further comprising:

a first load cylinder operatively attached to said upper assembly and said lower assembly for imparting a rotational force to said upper assembly and said lower assembly.

8. The apparatus of claim 7 further comprising:

a second load cylinder operatively attached to said upper assembly and said lower assembly for imparting a rotational force to said lower assembly and said upper assembly.

9. The apparatus of claim 4 wherein said first gear mechanism includes teeth that engage the first driven rack, and wherein movement of the first driving rack simultaneously effects movement of the teeth of the first gear mechanism and said first driven jaw.

10. The apparatus of claim 4 wherein said second gear mechanism includes teeth that engage the second driven rack, and wherein movement of the second driving rack simultaneously effects movement of the teeth of the second gear mechanism and said second driven jaw.

11. An apparatus for making up a tubular connection, the apparatus comprising:

a first assembly having first jaw mechanism, wherein said first jaw mechanism includes a first driving jaw operatively associated with a first driving rack and a second driving rack, a first driven jaw operatively associated with a first driven rack, and a second driven jaw operatively associated with a second driven rack;

a second assembly having second jaw mechanism, wherein said second jaw mechanism includes a second driving jaw operatively associated with a third driving rack and a fourth driving rack, a third driven jaw operatively associated with a third driven rack, and a fourth driven jaw operatively associated with a fourth driven rack;

first gear means, operatively associated with said first assembly, for advancing said first jaw mechanism;

second gear means, operatively associated with said second assembly, for advancing said second jaw mechanism.

12. The apparatus of claim 11 wherein said first gear means includes a first driver cylinder mechanism for driving said first driving jaw, a primary idler gear and a secondary idler gear, wherein said primary idler gear is engaged with the first driving jaw so that movement of the first driving jaw effects movement of the first driven jaw.

13. The apparatus of claim 11 wherein said second gear means includes a second driver cylinder mechanism for driving said second driving jaw, a primary idler gear and a secondary idler gear, wherein said primary idler gear is engaged with the second driving jaw so that movement of the second driving jaw effects movement of the third driven jaw.

14. The apparatus of claim 11 further comprising:

a first load cylinder operatively attached to said first assembly for imparting a rotational force to said first assembly relative to said second assembly.

15. The apparatus of claim 14 further comprising:

a second load cylinder operatively attached to said second assembly for imparting a rotational force to said second assembly relative to said first assembly.

16. An apparatus for engaging a tubular member, the apparatus comprising:

an upper assembly having a first driving jaw device containing a first driving rack and a second driving rack, a first driven jaw device containing a first driven rack, and a second driven jaw device containing a second driven rack;

first and second gear members operatively associated with said first driving rack and said first driven rack;

third and fourth gear members a second gear member operatively associated with said second driving rack and said second driven rack;

a driver cylinder operatively connected to said first driving jaw device, said driver cylinder moveable from a contracted position to an expanded position, and wherein said movement of said first driving jaw device causes movement of said first driven jaw device and said second driven jaw device in order to engage the first driving jaw device, the first driven jaw device and the second driven jaw device with the tubular member.

17. The apparatus of claim 16 further comprising:

a lower assembly having a second driving jaw device containing a third driving rack and a fourth driving rack, a third driven jaw device containing a third driven rack and a fourth driven jaw device containing a fourth driven rack, and wherein said movement of said second driving jaw device causes movement of said third driven jaw device and said fourth driven jaw device in order to engage the second driving jaw device, the third driven jaw device, and the fourth driven jaw device with the tubular member.

18. The apparatus of claim 16 further comprising:

a first load cylinder operatively attached to said upper assembly for imparting a rotational force to said upper assembly.

19. The apparatus of claim 18 further comprising:

a second load cylinder operatively attached to said lower assembly for imparting a rotational force to said lower assembly.

20. The apparatus of claim 18 wherein the first gear member contains teeth that engage the first driving rack and the second gear member contains teeth that engage the second driving rack, and wherein the movement of the second driving rack and the first driving rack generates movement of the first driven jaw device and second driven jaw device.

21. The apparatus of claim 20 further comprising:

a spinning device for rotating the tubular member.

22. The apparatus of claim 21 wherein the first driving jaw device, the first driven jaw device, and the second driven jaw device contains a die insert.

23. A method of torquing a first tubular with a second tubular, the method comprising:

providing a first apparatus and second apparatus, wherein the first apparatus comprises: a first driving jaw having a first driving rack and a second driving rack, a first driven jaw having a first driven rack, a second driven jaw having a second driven rack, first gear mechanism engaging the first driven rack and the first driving rack, and a second gear mechanism engaging the second driving rack and the second driven rack; and wherein the second apparatus comprises: a second driving jaw having a third driving rack and a fourth driving rack, a third driven jaw having a third driven rack, a fourth driven jaw having an fourth driven rack, third gear mechanism engaging the third driving rack and the third driven rack, and a fourth gear mechanism engaging the fourth driving rack and the fourth driven rack;

advancing the first driving jaw;

engaging the first driving rack with teeth of the first gear mechanism;

engaging the third driving rack with teeth of the second gear mechanism;

simultaneously advancing the first driving jaw, the first driven jaw and the second driven jaw;

simultaneously contacting the first driving jaw, the first driven jaw and the second driven jaw with the first tubular so that the first tubular is centered within the first apparatus;

advancing the second driving jaw;

engaging the third driving rack with teeth of the third gear mechanism;

engaging the fourth driving rack with teeth of the fourth gear mechanism;

simultaneously advancing the second driving jaw, the third driven jaw and the fourth driven jaw;

simultaneously contacting the second driving jaw, the third driven jaw and the fourth driven jaw with the second tubular so that the second tubular is centered with the second apparatus;

applying torque to the first tubular in order to connect the first tubular with the second tubular.

24. The method of claim 23 wherein the step of advancing the first driving jaw includes extending a piston rod from a driver cylinder so that the first driving rack and the second driving rack is advanced.

* * * * *